US006272882B1

(12) United States Patent
Hodges et al.

(10) Patent No.: US 6,272,882 B1
(45) Date of Patent: Aug. 14, 2001

(54) PROCESS OF LIQUEFYING A GASEOUS, METHANE-RICH FEED TO OBTAIN LIQUEFIED NATURAL GAS

(75) Inventors: Derek William Hodges, Perth (AU); Hendrik Frans Grootjans, The Hague (NL); Jonathan Reynolds Dolby, Burswood (AU)

(73) Assignee: Shell Research Limited (GB)

( * ) Notice: Subject to any disclaimer, the term of this patent is extended or adjusted under 35 U.S.C. 154(b) by 0 days.

(21) Appl. No.: 09/555,913

(22) PCT Filed: Dec. 11, 1998

(86) PCT No.: PCT/EP98/08133

§ 371 Date: Jun. 6, 2000

§ 102(e) Date: Jun. 6, 2000

(87) PCT Pub. No.: WO99/31448

PCT Pub. Date: Jun. 24, 1999

(30) Foreign Application Priority Data

Dec. 12, 1997 (EP) ..... 97203915

(51) Int. Cl.[7] ..... F25T 3/00
(52) U.S. Cl. ..... 62/613; 62/619; 62/657
(58) Field of Search ..... 62/613, 619, 657

(56) References Cited

U.S. PATENT DOCUMENTS

| | | | | |
|---|---|---|---|---|
| 4,755,200 | | 7/1988 | Liu et al. | 364/149 |
| 5,486,995 | | 1/1996 | Krist et al. | 364/149 |
| 5,651,269 | * | 7/1997 | Prevost et al. | 62/613 |
| 5,651,270 | * | 7/1997 | Low et al. | 62/657 |
| 5,893,274 | * | 4/1999 | Nagelvoort et al. | 62/613 |

FOREIGN PATENT DOCUMENTS 252455 1/1988 (EP) .
701186 3/1996 (EP) .

* cited by examiner

*Primary Examiner*—Ronald Capossela
(74) *Attorney, Agent, or Firm*—Kim Muller

(57) ABSTRACT

The present invention relates to a process of liquefying a gaseous, methane-rich feed to obtain a liquefied product by supplying the gaseous, methane-rich feed at elevated pressure to a first tube side of a main heat exchanger at its warm end, cooling, liquefying and sub-cooling the gaseous, methane-rich feed against evaporating refrigerant to get a liquefied stream, removing the liquefied stream from the main heat exchanger at its cold end and passing the liquefied stream to storage as liquefied product, removing evaporated refrigerant from the shell side of the main heat exchanger at its warm end, compressing in at least one refrigerant compressor the evaporated refrigerant to get high-pressure refrigerant, partly condensing the high-pressure refrigerant and separating the partly-condensed refrigerant into a liquid heavy refrigerant fraction and a gaseous light refrigerant fraction, sub-cooling the heavy refrigerant fraction in a second tube side of the main heat exchanger to get a sub-cooled heavy refrigerant stream, introducing the heavy refrigerant stream at reduced pressure into the shell side of the main heat exchanger at its mid-point, and allowing the heavy refrigerant stream to evaporate in the shell side, cooling, liquefying and sub-cooling at least part of the light refrigerant fraction in a third tube side of the main heat exchanger to get a sub-cooled light refrigerant stream, introducing the light refrigerant stream at reduced pressure into the shell side of the main heat exchanger at its cold end, allowing the light refrigerant stream to evaporate in the shell side, and controlling the liquefaction process using a process controller to determine simultaneously control actions for a set of manipulated variables in order to optimize at least one of a set of parameters while controlling at least one of a set of controlled variables.

12 Claims, 2 Drawing Sheets

Figure 1:
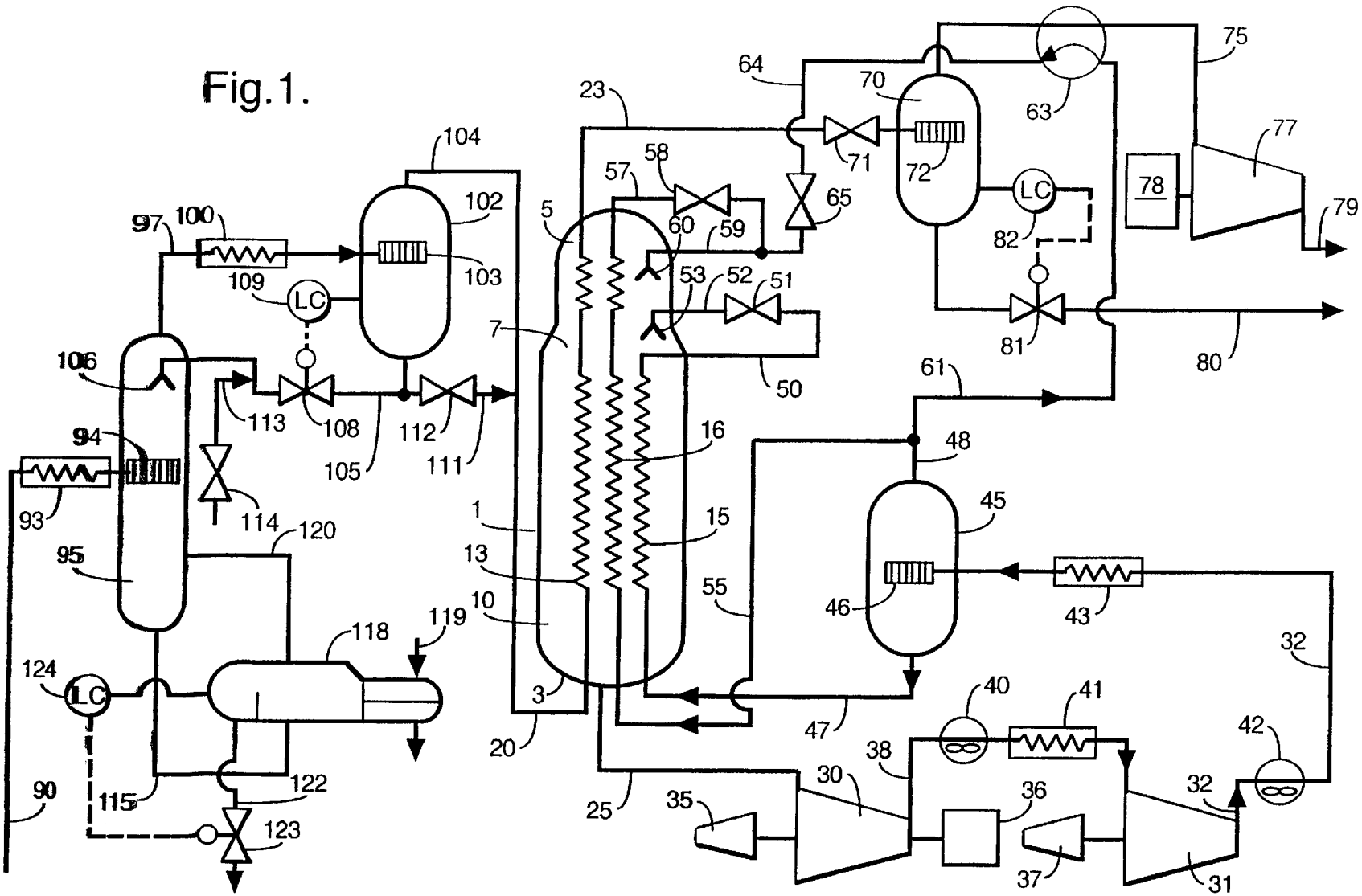

PROCESS OF LIQUEFYING A GASEOUS, METHANE-RICH FEED TO OBTAIN LIQUEFIED NATURAL GAS

The present invention relates to a process of liquefying a gaseous, methane-rich feed to obtain a liquefied product. The liquefied product is commonly called liquefied natural gas. The liquefaction process comprises the steps of:

(a) supplying the gaseous, methane-rich feed at elevated pressure to a first tube side of a main heat exchanger at its warm end, cooling, liquefying and sub-cooling the gaseous, methane-rich feed against evaporating refrigerant to get a liquefied stream, removing the liquefied stream from the main heat exchanger at its cold end and passing the liquefied stream to storage as liquefied product;

(b) removing evaporated refrigerant from the shell side of the main heat exchanger at its warm end;

(c) compressing in at least one refrigerant compressor the evaporated refrigerant to get high-pressure refrigerant;

(d) partly condensing the high-pressure refrigerant and separating the partly-condensed refrigerant into a liquid heavy refrigerant fraction and a gaseous light refrigerant fraction;

(e) sub-cooling the heavy refrigerant fraction in a second tube side of the main heat exchanger to get a sub-cooled heavy refrigerant stream, introducing the heavy refrigerant stream at reduced pressure into the shell side of the main heat exchanger at its mid-point, and allowing the heavy refrigerant stream to evaporate in the shell side; and (f) cooling, liquefying and sub-cooling at least part of the light refrigerant fraction in a third tube side of the main heat exchanger to get a sub-cooled light refrigerant stream, introducing the light refrigerant stream at reduced pressure into the shell side of the main heat exchanger at its cold end, and allowing the light refrigerant stream to evaporate in the shell side.

Australian patent No. AU-B-75 223/87 discloses a process of controlling a liquefaction process. The known control process has different strategies for three cases, (1) where the production of liquefied product is below a desired rate, it should be increased by adjusting the composition of the refrigerant taking into account the temperature difference at the cold end of the main heat exchanger; (2) where the production is above a desired rate, it should be decreased by decreasing the suction pressure of the refrigerant compressor; and (3) where the production is at its desired rate, the overall facility efficiency should be optimized by maintaining the refrigerant inventory in a predetermined range. In the cases (1) and (2) the refrigerant inventory and composition and the refrigerant compression ratio should be optimized with respect to overall efficiency.

When the production is at its desired rate, optimization starts with verifying the refrigerant inventory. Then the following refrigerant-related variables are subsequently adjusted: the ratio of the mass flows of heavy refrigerant fraction and light refrigerant fraction, the nitrogen content of the refrigerant and the $C_3$:$C_2$ ratio to achieve peak efficiency. Then the compression ratio of the refrigerant compressor(s) is adjusted to achieve peak efficiency. The last optimization step is adjusting the speed of the refrigerant compressor(s).

When other critical parameters, such as temperature difference at the cold or the warm end of the main heat exchanger would fall below or exceed a predetermined value or range an alarm is set, and the automatic control process is aborted.

A drawback of the known control process is that it requires continuously adjusting the composition of the refrigerant in order to optimize the production. Further drawbacks are that the optimization is done sequentially and that the automatic process control cannot handle a situation wherein, for example the temperature difference at the warm end of the heat exchanger is outside a predetermined range.

To overcome these drawbacks the process of liquefying a gaseous, methane-rich feed to obtain a liquefied product according to the present invention is characterized in that the process further comprises controlling the liquefaction process using an advanced process controller based on model predictive control to determine simultaneously control actions for a set of manipulated variables in order to optimize at least one of a set of parameters whilst controlling at least one of a set of controlled variables, wherein the set of manipulated variables includes the mass flow rate of the heavy refrigerant fraction, the mass flow rate of the light refrigerant fraction and the mass flow rate of the methane-rich feed, wherein the set of controlled variables includes the temperature difference at the warm end of the main heat exchanger and the temperature difference at the mid-point of the main heat exchanger, and wherein the set of parameters to be optimized includes the production of liquefied product.

In the specification and in the claim the expression 'optimizing a variable' is used to refer to maximizing or minimizing the variable and to maintaining the variable at a predetermined value.

Model predictive control or model based predictive control is a well-known technique, see for example Perry's Chemical Engineers' Handbook, 7th Edition, pages 8–25 to 8–27. A key feature of model predictive control is that future process behaviour is predicted using a model and available measurements of the controlled variables. The controller outputs are calculated so as to optimize a performance index, which is a linear or quadratic function of the predicted errors and calculated future control moves. At each sampling instant, the control calculations are repeated and the predictions updated based on current measurements. A suitable model is one that comprises a set of empirical step-response models expressing the effects of a step-response of a manipulated variable on the controlled variables.

An optimum value for the parameter to be optimized can be obtained from a separate optimization step, or the variable to be optimized can be included in the performance function.

Before model predictive control can be applied, one determines first the effect of step changes of the manipulated variables on the variable to be optimized and on the controlled variables. This results in a set of step-response coefficients. This set of step-response coefficients forms the basis of the model predictive control of the liquefaction process.

During normal operation, the predicted values of the controlled variables are regularly calculated for a number of future control moves. For these future control moves a performance index is calculated. The performance index includes two terms, a first term representing the sum over the future control moves of the predicted error for each control move and a second term representing the sum over the future control moves of the change in the manipulated variables for each control move. For each controlled variable, the predicted error is the difference between the predicted value of the controlled variable and a reference value of the controlled variable. The predicted errors are multiplied with a weighting factor, and the changes in the manipulated variables for a control move are multiplied with a move suppression factor. The performance index discussed here is linear.

Alternatively, the terms may be a sum of squared terms, in which case the performance index is quadratic.

Moreover, constraints can be set on manipulated variables, change in manipulated variables and on controlled variables. This results in a separate set of equations that are solved simultaneously with the minimization of the performance index.

Optimization can be done in two ways; one way is to optimize separately, outside the minimization of the performance index, and the second way is to optimize within the performance index.

When optimization is done separately, the parameters to be optimized are included as controlled variables in the predicted error for each control move and the optimization gives a reference value for the controlled variables.

Alternatively, optimization is done within the calculation of the performance index, and this gives a third term in the performance index with an appropriate weighting factor. In this case, the reference values of the controlled variables are pre-determined steady state values which remain constant.

The performance index is minimized taking into account the constraints to give the values of the manipulated variables for the future control moves. However, only the next control move is executed. Then the calculation of the performance index for future control moves starts again.

The models with the step response coefficients and the equations required in model predictive control are part of a computer program which is executed in order to control the liquefaction process. A computer program loaded with such a program which can handle model predictive control is called an advanced process controller. Because the computer programs are commercially available, we will not discuss such programs in detail. The present invention is more directed to selecting the variables.

Figure 2:
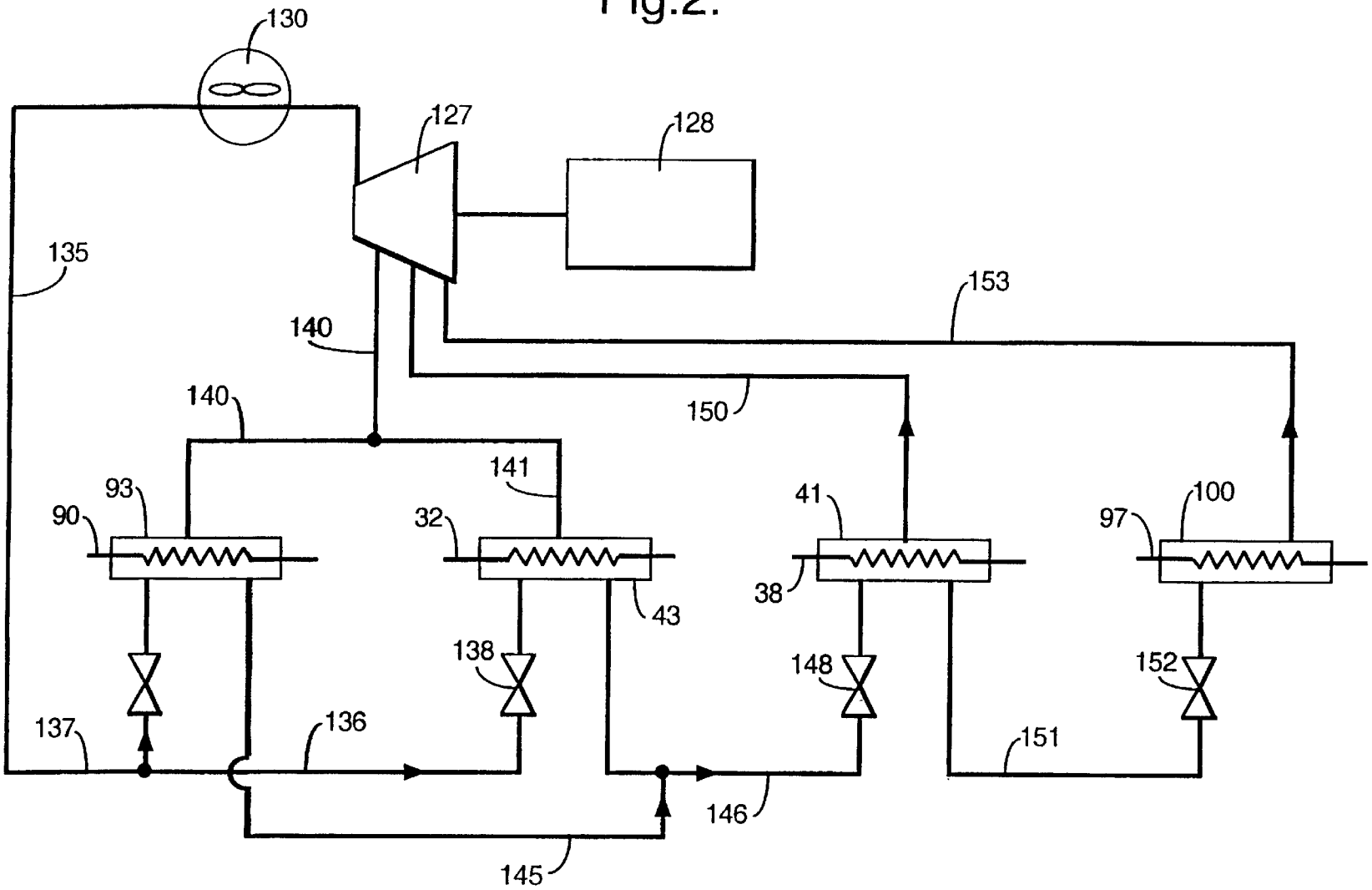

The invention will now be described by way of example with reference to the accompanying drawings, wherein FIG. 1 shows schematically a flow scheme of a plant for liquefying natural gas; and FIG. 2 shows schematically the propane cooling cycle.

Reference is now made to FIG. 1. The plant for liquefying natural gas comprises a main heat exchanger 1 with a warm end 3, a cold end 5 and a mid-point 7. The wall of the main heat exchanger 1 defines a shell side 10. In the shell side 10 are located a first tube side 13 extending from the warm end 3 to the cold end 5, a second tube side 15 extending from the warm end 3 to the mid-point 7 and a third tube side 16 extending from the warm end 3 to the cold end 5.

During normal operation, a gaseous, methane-rich feed is supplied at elevated pressure through supply conduit 20 to the first tube side 13 of the main heat exchanger 1 at its warm end 3. The feed which passes through the first tube side 13 is cooled, liquefied and sub-cooled against refrigerant evaporating in the shell side 10. The resulting liquefied stream is removed from the main heat exchanger 1 at its cold end 5 through conduit 23. The liquefied stream is passed to storage where it is stored as liquefied product.

Evaporated refrigerant is removed from the shell side 10 of the main heat exchanger 1 at its warm end 3 through conduit 25. In refrigerant compressors 30 and 31, the evaporated refrigerant is compressed to get high-pressure refrigerant which is removed through conduit 32.

The first refrigerant compressor 30 is driven by a suitable motor, for example a gas turbine 35, which is provided with a helper motor 36 for start-up, and the second refrigerant compressor 31 is driven by a suitable motor, for example a gas turbine 37 provided with a helper motor (not shown). In between the two refrigerant compressors 30 and 31, heat of compression is removed from the fluid passing through conduit 38 in air cooler 40 and heat exchanger 41.

Refrigerant at high pressure in conduit 32 is cooled in air cooler 42 and partly condensed in heat exchanger 43 to obtain partly-condensed refrigerant.

The high-pressure refrigerant is introduced into separator vessel 45 through inlet device 46. In the separator vessel 45, the partly-condensed refrigerant is separated into a liquid heavy refrigerant fraction and a gaseous light refrigerant fraction. The liquid heavy refrigerant fraction is removed from the separator vessel 45 through conduit 47, and the gaseous light refrigerant fraction is removed through conduit 48.

The heavy refrigerant fraction is sub-cooled in the second tube side 15 of the main heat exchanger 1 to get a sub-cooled heavy refrigerant stream. The sub-cooled heavy refrigerant stream is removed from the main heat exchanger 1 through conduit 50, and allowed to expand over an expansion device in the form of an expansion valve 51. At reduced pressure it is introduced through conduit 52 and nozzle 53 into the shell side 10 of the main heat exchanger 1 at its mid-point 7. The heavy refrigerant stream is allowed to evaporate in the shell side 10 at reduced pressure, thereby cooling the fluids in the tube sides 13, 15 and 16.

Part of the gaseous light refrigerant fraction removed through conduit 48 is passed through conduit 55 to the third tube side 16 in the main heat exchanger 1 where it is cooled, liquefied and sub-cooled to get a sub-cooled light refrigerant stream. The sub-cooled light refrigerant stream is removed from the main heat exchanger 1 through conduit 57, and allowed to expand over an expansion device in the form of an expansion valve 58. At reduced pressure it is introduced through conduit 59 and nozzle 60 into the shell side 10 of the main heat exchanger 1 at its cold end 5. The light refrigerant stream is allowed to evaporate in the shell side 10 at reduced pressure, thereby cooling the fluids in the tube sides 13, 15 and 16.

The remainder of the light refrigerant fraction removed through conduit 48 is passed through conduit 61 to a heat exchanger 63, where it is cooled, liquefied and sub-cooled. Through conduit 64 provided with an expansion valve 65 it is supplied from the heat exchanger 63 to conduit 59.

The resulting liquefied stream is removed from the main heat exchanger 1 through the conduit 23 and passed to flash vessel 70. The conduit 23 is provided with an expansion device in the form of an expansion valve 71 in order to allow reduction of the pressure, so that the resulting liquefied stream is introduced via inlet device 72 in the flash vessel 70 at a reduced pressure. The reduced pressure is suitably substantially equal to atmospheric pressure. Expansion valve 71 also regulates the total flow.

From the top of the flash vessel 70 an off-gas is removed through conduit 75. The off-gas is compressed in an end-flash compressor 77 driven by motor 78 to get high-pressure fuel gas which is removed through conduit 79. The off-gas cools, liquefies and sub-cools the light refrigerant fraction in heat exchanger 63.

From the bottom of the flash vessel 70 liquefied product is removed through conduit 80 and passed to storage (not shown).

A first objective is to maximize production of liquefied product flowing through conduit 80 which is manipulated by valve 71.

The above described model predictive control is used to achieve this objective. The set of manipulated variables includes the mass flow rate of the heavy refrigerant fraction flowing through conduit 52 (expansion valve 51), the mass flow rate of the light refrigerant fraction flowing through conduit 59 (expansion valve 58 and valve 62), and the mass flow rate of the methane-rich feed through conduit 20 (which is manipulated by valve 71). The set of controlled variables includes the temperature difference at the warm end 3 of the main heat exchanger 1 (which is the difference between the temperature of the fluid in conduit 47 and the temperature in conduit 25) and the temperature difference at the mid-point 7 of the main heat exchanger 1 (which is the difference between the fluid in the conduit 50 and the temperature of the fluid in the shell side 10 at the mid-point 7 of the main heat exchanger 1). By selecting these variables, control of the main heat exchanger 1 with advanced process control based on model predictive control is achieved.

Applicant has found that when using the model predictive control and when using as manipulated variables the mass flow rate of the heavy refrigerant fraction, the mass flow rate of the light refrigerant fraction, and the mass flow rate of the methane-rich feed, an efficient and rapid control can be achieved which allows optimizing the production of liquefied product and controlling the temperature profile in the main heat exchanger.

An advantage of the method of the present invention is that the bulk composition of the mixed refrigerant is not manipulated to optimize the production of liquefied product.

For the sake of completeness it is observed that conduit 80 is provided with a flow control valve 81 which is manipulated by a level controller 82 to ensure that during normal operation a sufficient liquid level is maintained in the flash vessel 70. However, the presence of this flow control valve 81 is not relevant to the optimization according to the present invention because the valve 81 is not manipulated when the inflow of liquid into the flash vessel 70 matches the outflow of liquid from the flash vessel 70.

In case the production of liquefied product has to be maintained on a predetermined level, model predictive control allows to control temperature profile in the main heat exchanger 1. To this end the set of controlled variables further includes the temperature of the liquefied stream removed from the main heat exchanger 1 which stream flows through conduit 23.

A further objective of the present invention is to maximize the utilization of the compressors. To this end the set of manipulated variables further includes the speed of the refrigerant compressors 30 and 31.

The gaseous, methane-rich feed which is supplied to the main heat exchanger 1 through conduit 20 is obtained from a natural gas feed by partly condensing the natural gas feed to obtain a partly condensed feed of which the gaseous phase is supplied to the main heat exchanger 1. The natural gas feed is passed through supply conduit 90. Partly condensing the natural gas feed is done in at least one heat exchanger 93.

The partly condensed feed is introduced via inlet device 94 into a scrub column 95. In the scrub column 95, the partly condensed feed is fractionated to get a gaseous overhead stream and a liquid, methane-depleted bottom stream. The gaseous overhead stream is passed through conduit 97 via heat exchanger 100 to an overhead separator 102. In the heat exchanger 100, the gaseous overhead stream is partly condensed, and the partly condensed overhead stream is introduced into the overhead separator 102 via inlet device 103. In the overhead separator 102, the partly condensed overhead stream is separated into a gaseous, methane-rich stream and a liquid bottom stream.

The gaseous, methane-rich stream removed through conduit 104 forms the gaseous, methane-rich feed in the conduit 20. At least part of the liquid bottom stream is introduced through conduit 105 and nozzle 106 into the scrub column 95 as reflux. The conduit 105 is provided with a flow control valve 108 which is manipulated by a level controller 109 to maintain a fixed level in the overhead separator 102.

If there is less reflux required than there is liquid in the partly condensed gaseous overhead stream, the surplus can be passed on to the main heat exchanger 1 through conduit 111 provided with flow control valve 112. The set of manipulated variables then includes the mass flow rate of the excess liquid bottom stream that flows through conduit 111.

In case too little reflux is available, butane can be added from source (not shown) through conduit 113 provided with flow control valve 114. In that case the set of manipulated variable further includes the mass flow rate of the butane-containing stream flowing through conduit 113.

The liquid, methane-depleted bottom stream is removed from the scrub column 95 via conduit 115. To provide vapour for stripping, the liquid, methane-depleted bottom stream is partly evaporated in heat exchanger 118 by indirect heat exchange with a suitable hot medium such as hot water or steam supplied through conduit 119. The vapour is introduced into the lower part of the scrub column 95 through conduit 120, and liquid is removed from the heat exchanger 118 through conduit 122 provided with flow control valve 123 which is manipulated by level controller 124 to maintain a fixed level in the shell side of the heat exchanger 118.

In order to integrate the control of the scrub column 95 with the control of the main heat exchanger 1, the set of manipulated variables further includes the temperature of the liquid, methane-depleted bottom stream in conduit 122. Furthermore, the set of controlled variables further includes the concentration of heavier hydrocarbons in the gaseous, methane-rich stream (in conduit 104), the concentration of methane in the liquid, methane-depleted bottom stream in conduit 122, the mass flow rate of the liquid, methane-depleted bottom stream in conduit 122 and the reflux mass flow rate, which is the mass flow rate of the reflux flowing through conduit 105. The set of parameters to be optimized further includes the heating value of the liquefied product. The heating value is calculated from an analysis of the composition of the liquefied product flowing through conduit 80. The analysis can be made by means of gas chromatography.

The temperature of the liquid, methane-depleted bottom stream in conduit 122 is manipulated by regulating the heat input to the heat exchanger 118.

At several instances, heat exchangers are used to remove heat from a fluid, for example to partly condense the fluid. In heat exchanger 41 heat is removed from partly compressed refrigerant, in heat exchanger 43 high pressure refrigerant is partly condensed, in heat exchanger 93 the natural gas feed is partly condensed, and in heat exchanger 100 the gaseous overhead stream is partly condensed. In these heat exchangers, heat is removed by means of indirect heat exchange with propane evaporating at a suitable pressure.

FIG. 2 shows schematically an example of the propane cycle. Evaporated propane is compressed in a propane compressor 127 driven by a suitable motor, such as a gas turbine 128. Propane is condensed in air cooler 130, and condensed propane at elevated pressure is passed through conduits 135 and 136 to heat exchangers 93 and 43 which are arranged parallel to each other. The condensed propane is allowed to expand to a high intermediate pressure over expansion valves 137 and 138 before entering into heat exchangers 93 and 43. The gaseous fraction is passed through conduits 140 and 141 to an inlet of the propane compressor 127. The liquid fraction is passed through conduits 145 and 146 to the heat exchanger 41. Before entering into the heat exchanger 41, the propane is allowed to expand to a low intermediate pressure over expansion valve 148. The gaseous fraction is passed through conduit 150 to an inlet of the propane compressor 127. The liquid fraction is passed through conduits 151 to the heat exchanger 100. Before entering into the heat exchanger 41, the propane is allowed to expand to a low pressure over expansion valve 152. The propane at low pressure is passed to an inlet of the propane compressor 127 through conduit 153.

In order to integrate the control of the propane cycle with the control of the main heat exchanger 1, the set of manipulated variables further includes the speed of the propane compressor 127, and the set of controlled variables further includes the suction pressure of the first propane compressor 127 which is the pressure of the propane in conduit 153. In this way the utilization of the propane compressor can be maximized.

In case the propane compressor comprises two compressors in series, the set of manipulated variables further includes the speeds of the two propane compressors, and the set of controlled variables further includes the suction pressure of the first propane compressor.

In order to further optimize the process, the set of controlled variables can further include the loading of the end flash compressor 77.

The bulk composition and the bulk inventory of the refrigerant inventory is separately controlled (not shown) to compensate for losses due to leaking. This is done outside the advanced process control of the main heat exchanger.

Below in Tables 1 and 2 a summary of the manipulated and controlled variables used in the claims is given.

TABLE 1

Summary of manipulated variables used in the claims

| Claim | Description | Reference numeral |
|---|---|---|
| 1 | the mass flow rate of the heavy refrigerant fraction | 51 |
| 1 | the mass flow rate of the light refrigerant fraction | 58, 62 |
| 1 | the mass flow rate of the methane-rich feed | 71 |
| 3 | the speed of the refrigerant compressors | 30, 31 |
| 7 | the temperature of the liquid, methane-depleted bottom stream | 122 |
| 8 | the mass flow rate of the butane-containing stream | 113 |
| 8 | the mass flow rate of the excess liquid bottom stream | 111 |
| 10 | the speed of the propane compressor | 127 |

TABLE 2

Summary of controlled variabies used in the claims

| Claim | Description | Reference numeral |
|---|---|---|
| 1 | the temperature difference at the warm end of the main heat exchanger | 3 |
| 1 | the temperature difference at the mid-point of the main heat exchanger | 7 |

TABLE 2-continued

Summary of controlled variabies used in the claims

| Claim | Description | Reference numeral |
|---|---|---|
| 2 | temperature of the liquefied stream removed from the main heat exchanger | 23 |
| 7 | the concentration of heavier hydrocarbons in the gaseous, methane-richstream | 104 |
| 7 | the concentration of methane in the liquid, methane-depleted bottom stream | 122 |
| 7 | the mass flow rate of the liquid, methane-depleted bottom stream | 122 |
| 7 | the reflux mass flow rate | 105 |
| 10 | the suction pressure of the first propane compressor | 153 |
| 11 | the loading of the end flash compressor | 77 |

What is claimed is:

1. Process of liquefying a gaseous, methane-rich feed to obtain a liquefied product, which liquefaction process comprises the steps of:

(a) supplying the gaseous, methane-rich feed at elevated pressure to a first tube side of a main heat exchanger at its warm end, cooling, liquefying and sub-cooling the gaseous, methane-rich feed against evaporating refrigerant to get a liquefied stream, removing the liquefied stream from the main heat exchanger at its cold end and passing the liquefied stream to storage as liquefied product;

(b) removing evaporated refrigerant from the shell side of the main heat exchanger at its warm end;

(c) compressing in at least one refrigerant compressor the evaporated refrigerant to get high-pressure refrigerant;

(d) partly condensing the high-pressure refrigerant and separating the partly-condensed refrigerant into a liquid heavy refrigerant fraction and a gaseous light refrigerant fraction;

(e) sub-cooling the heavy refrigerant fraction in a second tube side of the main heat exchanger to get a sub-cooled heavy refrigerant stream, introducing the heavy refrigerant stream at reduced pressure into the shell side of the main heat exchanger at its mid-point, and allowing the heavy refrigerant stream to evaporate in the shell side; and (f) cooling, liquefying and sub-cooling at least part of the light refrigerant fraction in a third tube side of the main heat exchanger to get a sub-cooled light refrigerant stream, introducing the light refrigerant stream at reduced pressure into the shell side of the main heat exchanger at its cold end, and allowing the light refrigerant stream to evaporate in the shell side, characterized in that the process further comprises controlling the liquefaction process using an advanced process controller based on model predictive control to determine simultaneously control actions for a set of manipulated variables in order to optimize at least one of a set of parameters whilst controlling at least one of a set of controlled variables, wherein the set of manipulated variables includes the mass flow rate of the heavy refrigerant fraction, the mass flow rate of the light refrigerant fraction and the mass flow rate of the methane-rich feed, wherein the set of controlled variables includes the temperature difference at the warm end of the main heat exchanger and the temperature difference at the mid-point of the main heat exchanger, and wherein the set of parameters to be optimized includes the production of liquefied product.

2. Process according to claim 1, characterized in that the set of controlled variables further includes the temperature of the liquefied stream removed from the main heat exchanger.

3. Process according to claim 1, characterized in that the set of manipulated variables further includes the speed of the refrigerant compressor(s) in order to maximize the utilization of the compressors.

4. Process according to claim 1, wherein partly condensing the high-pressure refrigerant in step (d) is done in at least one heat exchanger by means of indirect heat exchange with propane evaporating at a suitable pressure.

5. Process according to claim 4, wherein evaporated propane is compressed in at least one propane compressor stage and condensed by heat exchange with an external coolant, characterized in that the set of manipulated variables further includes the speed of the propane compressor (s), and in that the set of controlled variables further includes the suction pressure of the first propane compressor.

6. Process according to claim 1, wherein the gaseous, methane-rich feed is obtained from a natural gas feed by partly condensing the natural gas feed to obtain a partly condensed feed.

7. Process according to claim 6, wherein partly condensing the natural gas feed is done in at least one heat exchanger by means of indirect heat exchange with propane evaporating at a suitable pressure.

8. Process according to claim 6, further comprising fractionating the partly condensed feed in a scrub column to get a gaseous overhead stream and a liquid, methane-depleted bottom stream; and partly condensing the gaseous overhead stream and separating the gaseous overhead stream into a gaseous, methane-rich stream which forms the gaseous, methane-rich feed and a liquid bottom stream of which at least part is passed to the scrub column as reflux, characterized in that the set of manipulated variables further includes the temperature of the liquid, methane-depleted bottom stream, in that the set of controlled variables further includes the concentration of heavier hydrocarbons in the gaseous, methane-rich stream, the concentration of methane in the liquid, methane-depleted bottom stream, the mass flow rate of the liquid, methane-depleted bottom stream and the reflux mass flow rate, and in that the set of parameters to be optimized further includes the heating value of the liquefied product.

9. Process according to claim 8, further comprising adding a butane-containing stream to the reflux, characterized in that the set of manipulated variables further includes the mass flow rate of the excess liquid bottom stream and/or the mass flow rate of the butane-containing stream.

10. Process according to claim 8, wherein partly condensing the gaseous overhead stream is done in at least one heat exchanger by means of indirect heat exchange with propane evaporating at a suitable pressure.

11. Process according to claim 1, further comprising reducing the pressure of the liquefied stream to get the liquefied product which is passed to storage and an off-gas; and compressing in an end-flash compressor the off-gas to get high-pressure fuel gas, characterized in that the set of controlled variables further includes the loading of the end flash compressor.

12. Process according to claim 1, further comprising separately controlling the bulk composition and the bulk inventory of the refrigerant.

* * * * *